US006679012B1

(12) United States Patent
Chen et al.

(10) Patent No.: US 6,679,012 B1
(45) Date of Patent: Jan. 20, 2004

(54) EARTHQUAKE ENERGY ELIMINATOR

(76) Inventors: Ching-Shyang Chen, PO Box 82-144, Taipei (TW); Chiao-Yu Jen, PO Box 82-144, Taipei (TW)

( * ) Notice: Subject to any disclaimer, the term of this patent is extended or adjusted under 35 U.S.C. 154(b) by 0 days.

(21) Appl. No.: 10/179,184

(22) Filed: Jun. 26, 2002

(51) Int. Cl.[7] ..... E04B 1/98; E04H 9/02

(52) U.S. Cl. ..... 52/167.7; 52/167.8; 52/690; 248/638; 248/636; 108/158.12

(58) Field of Search ..... 52/167.7, 167.8, 52/167.1, 690, 696; 248/638, 636, 158, 346.3, 346.01, 165; 108/157.18, 158.12, 153.1, 60, 180

(56) References Cited

U.S. PATENT DOCUMENTS 2,597,800 A * 5/1952 Hussman ..... 248/565
4,366,659 A * 1/1983 Jensen ..... 52/693
4,633,628 A * 1/1987 Mostaghel ..... 52/167.7
5,201,155 A * 4/1993 Shimoda et al. ..... 52/167.7
5,373,670 A * 12/1994 Sasaki et al. ..... 52/167.7
5,546,716 A * 8/1996 Broxterman et al. ..... 52/220.1
5,655,756 A * 8/1997 Robinson ..... 267/140.2
5,971,347 A * 10/1999 Tsai et al. ..... 248/618
6,126,136 A * 10/2000 Yen et al. ..... 248/560

* cited by examiner

*Primary Examiner*—Carl D. Friedman
*Assistant Examiner*—Nahid Amiri
(74) *Attorney, Agent, or Firm*—Leong C. Lei

(57) ABSTRACT

An earthquake energy eliminator is constructed to include two bearing plates respectively disposed at top and bottom sides, the bearing plates each having a plurality of mounting holes, and a plurality of connecting plates connected between the bearing plates, the connecting plates each having respective top and bottom sides respectively fitted into the mounting holes of the bearing plates and at least one opening spaced between bearing plates.

2 Claims, 17 Drawing Sheets

EARTHQUAKE ENERGY ELIMINATOR

BACKGROUND OF THE INVENTION

1. Field of the invention

The present invention relates to building construction and, more specifically, to an earthquake energy eliminator for building construction, which is inexpensive to manufacture.

2. Description of the Related Art

Earthquake energy eliminators are commonly used in building construction and installed in between columns, posts, walls, braces, etc., of a building, bridge, airport construction to absorb and guide out shock waves during an earthquake. These earthquake energy eliminators are commonly comprised of two bearing plates arranged in parallel, and a V-shaped or X-shaped connecting plate connected between the bearing plates. The V-shaped or X-shaped connecting plate is fastened to the bearing plates by welding or fastening means. Conventional earthquake energy eliminators are commonly expensive to manufacture. When installed, they may obstruct the sense of beauty of the construction. Further, because the connecting plate is a flat solid member, the shock absorbing effect of conventional earthquake energy eliminators is limited.

SUMMARY OF THE INVENTION

The present invention has been accomplished to provide an earthquake energy eliminator, which eliminates the aforesaid drawbacks. It is one object of the present invention to provide an earthquake energy eliminator, which is inexpensive to manufacture and easy to install. It is another object of the present invention to provide an earthquake energy eliminator, which is achieves a satisfactory shock absorbing effect. It is still another object of the present invention to provide an earthquake energy eliminator, which does not destroy the sense of beauty of the construction when installed. T9o achieve these and other objects of the present invention, the earthquake energy eliminator comprises two bearing plates respectively disposed at top and bottom sides, the bearing plates each having a plurality of mounting holes, and a plurality of connecting plates connected between the bearing plates, the connecting plates each having respective top and bottom sides respectively fitted into the mounting holes of the bearing plates and at least one opening spaced between bearing plates. The mounting holes can be elongated blind holes or through holes of any of a variety of cross sections fitting the top and bottom sides of the connecting plates. The size of the mounting holes is slightly smaller than the cross section of the top and bottom sides of the connecting plates. The bearing plates are heated to expand the mounting holes before installation of the connecting plates, so that the top and bottom sides of the connecting plates can easily be fitted into the mounting holes of the bearing plates. The bearing plates and the connecting plates can be made of metal or industrial engineering plastics. The openings of the connecting plates may be variously shaped. When assembled, a welding apparatus may seal the connections between the bearing plates and the connecting plates.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
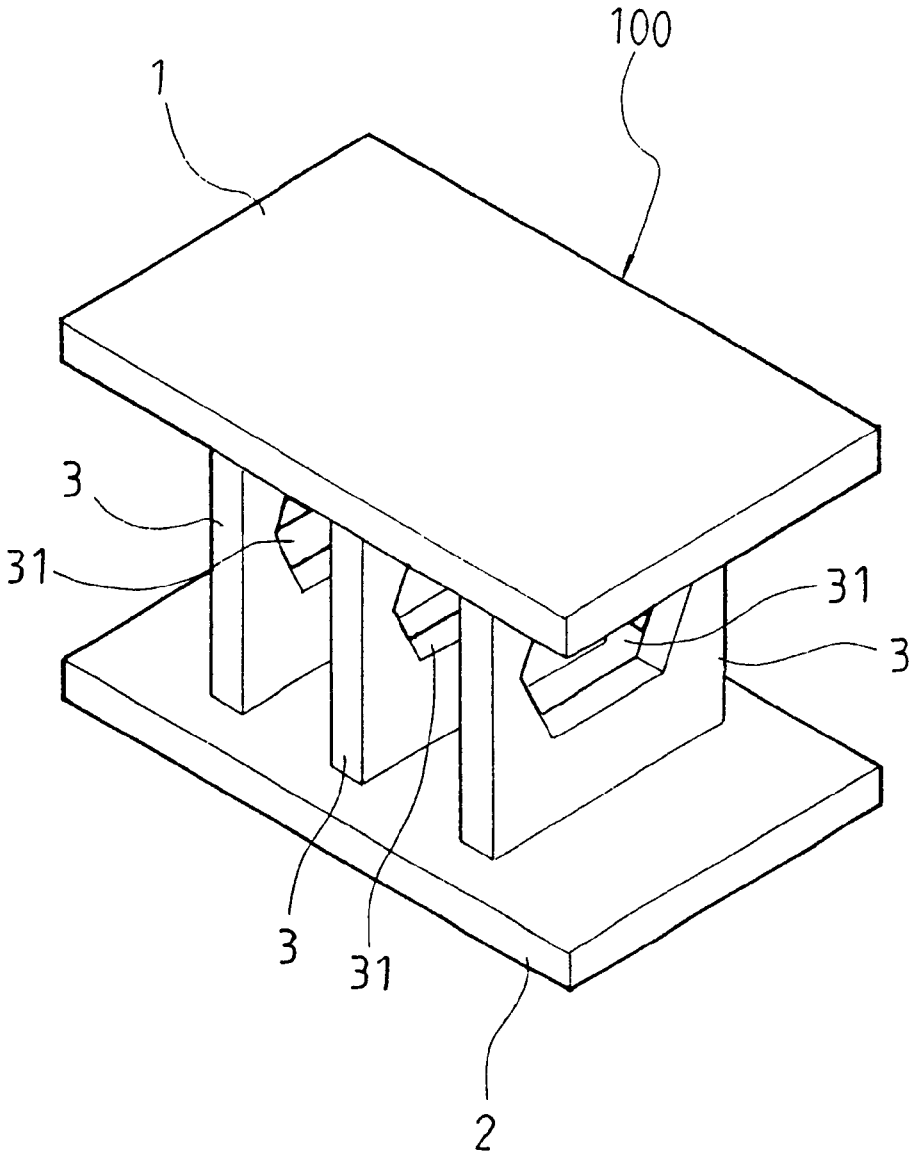
FIG. 1 is an elevational view of an earthquake energy eliminator according to one embodiment of the present invention.
Figure 2:
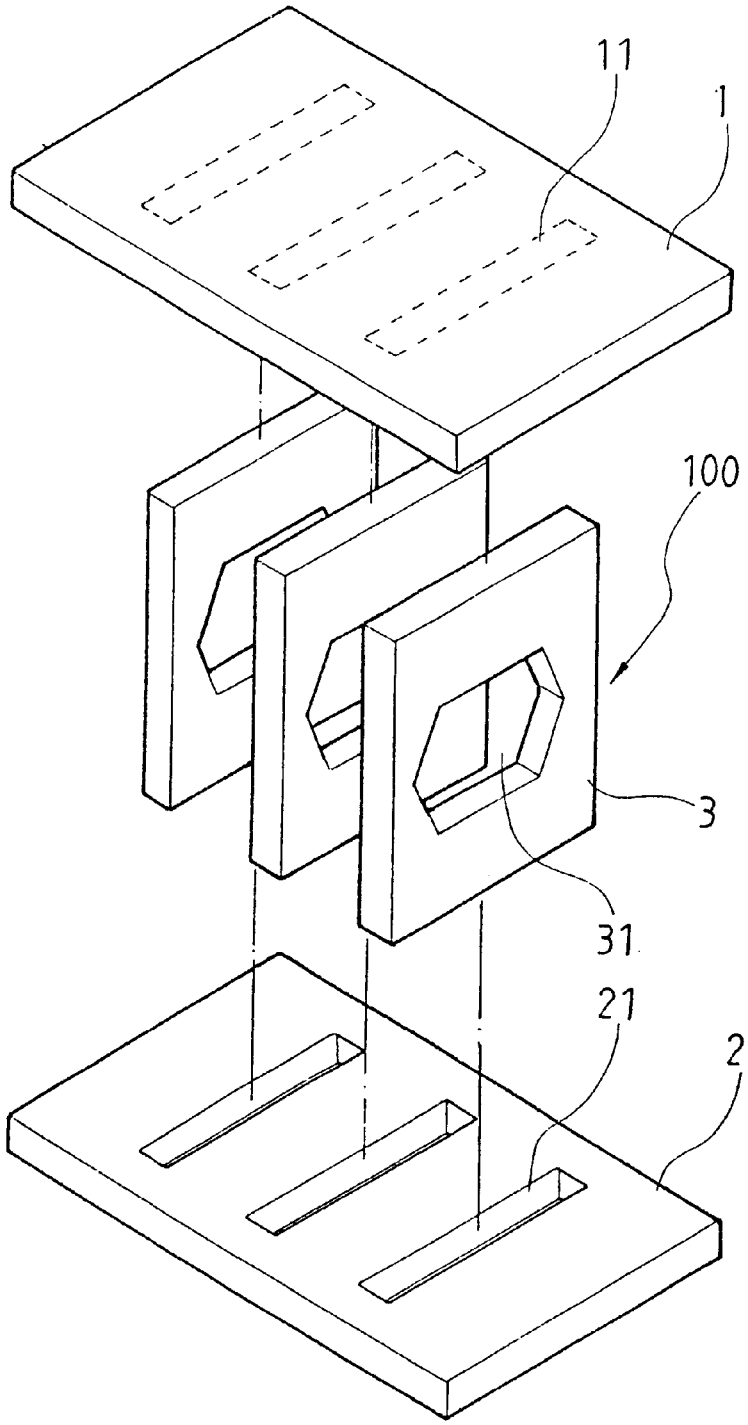
FIG. 2 is an exploded view of the earthquake energy eliminator shown in FIG. 1.
Figure 2A:
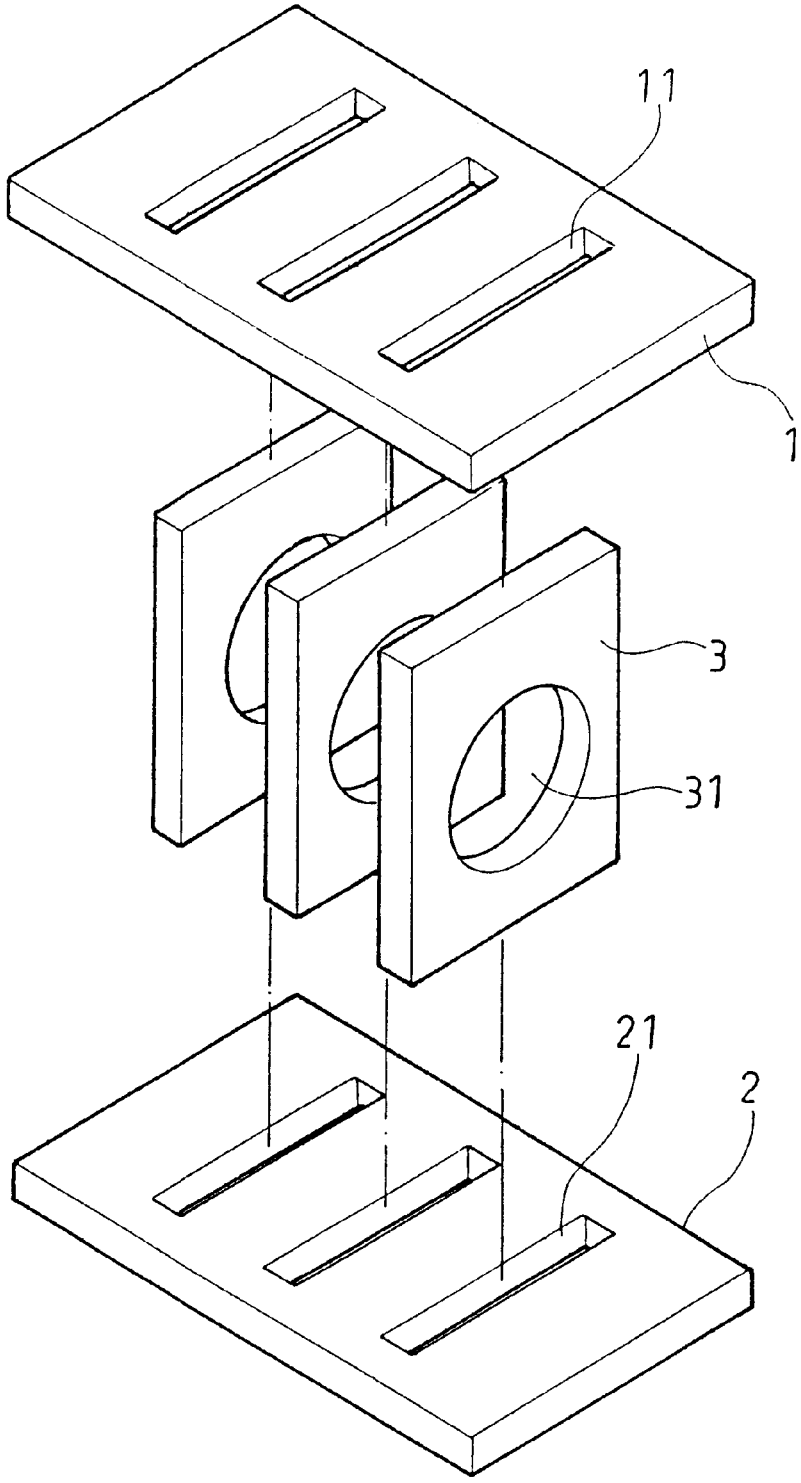
FIG. 2A is an exploded view of an alternate form of the earthquake energy eliminator according to the present invention.
Figure 3:
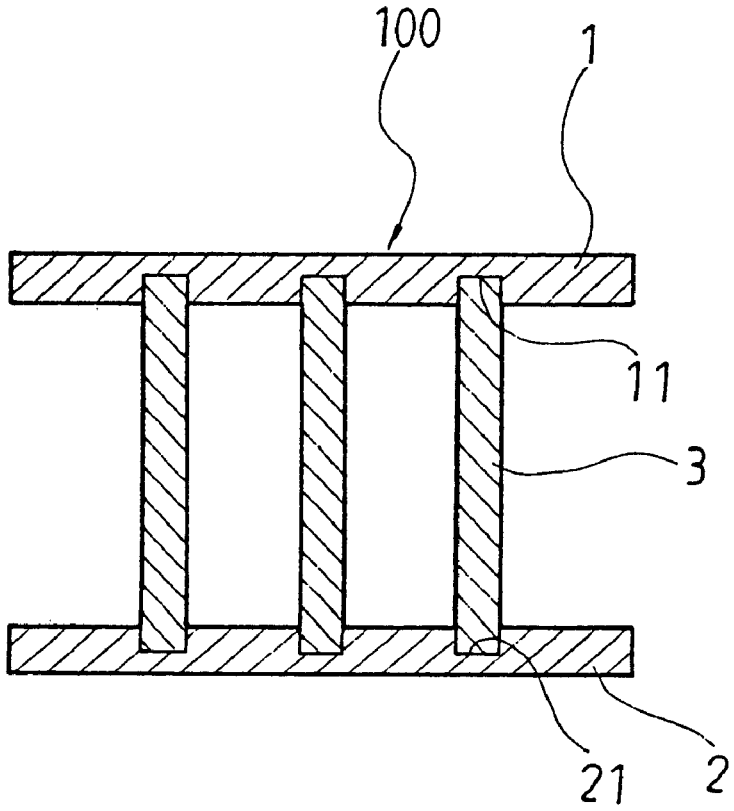
FIG. 3 is a longitudinal view in section of the earthquake energy eliminator shown in FIG. 1.
Figure 3A:
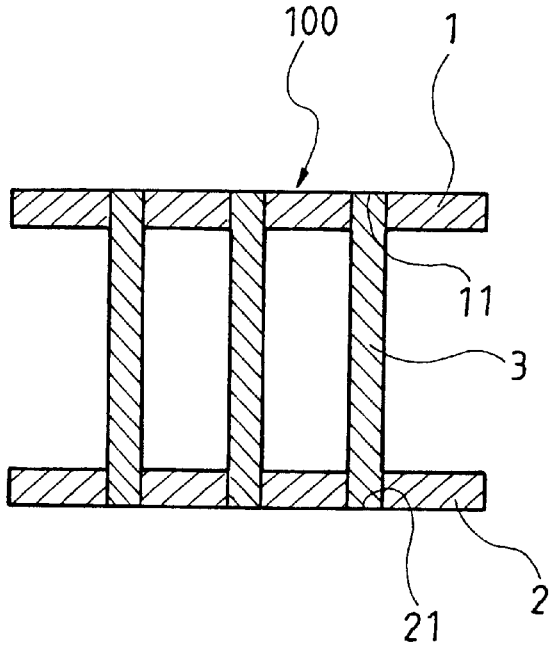
FIG. 3A is a longitudinal view in section of another alternate form of the earthquake energy eliminator according to the present invention.
Figure 3B:
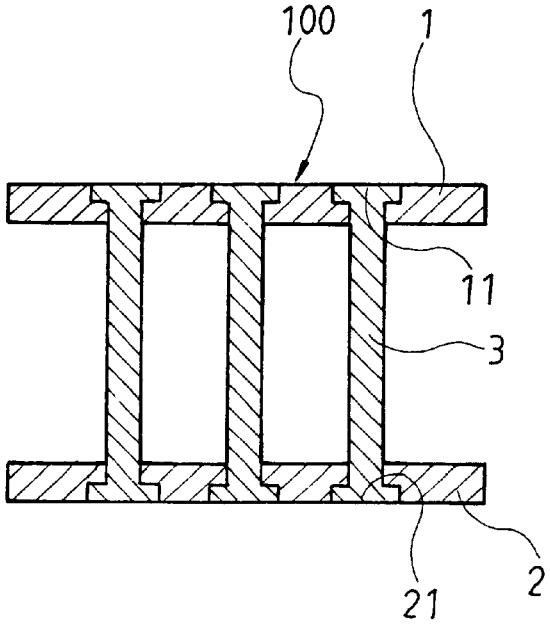
FIG. 3B is a longitudinal view in section of still another alternate form of the earthquake energy eliminator according to the present invention.
Figure 4:
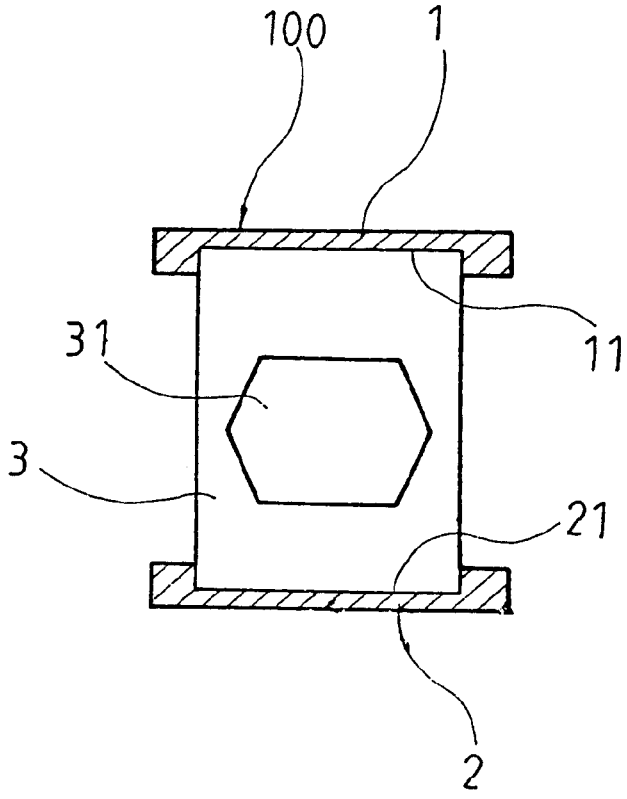
FIG. 4 is a transverse view in section of the earthquake energy eliminator shown in FIG. 1.
Figure 5:
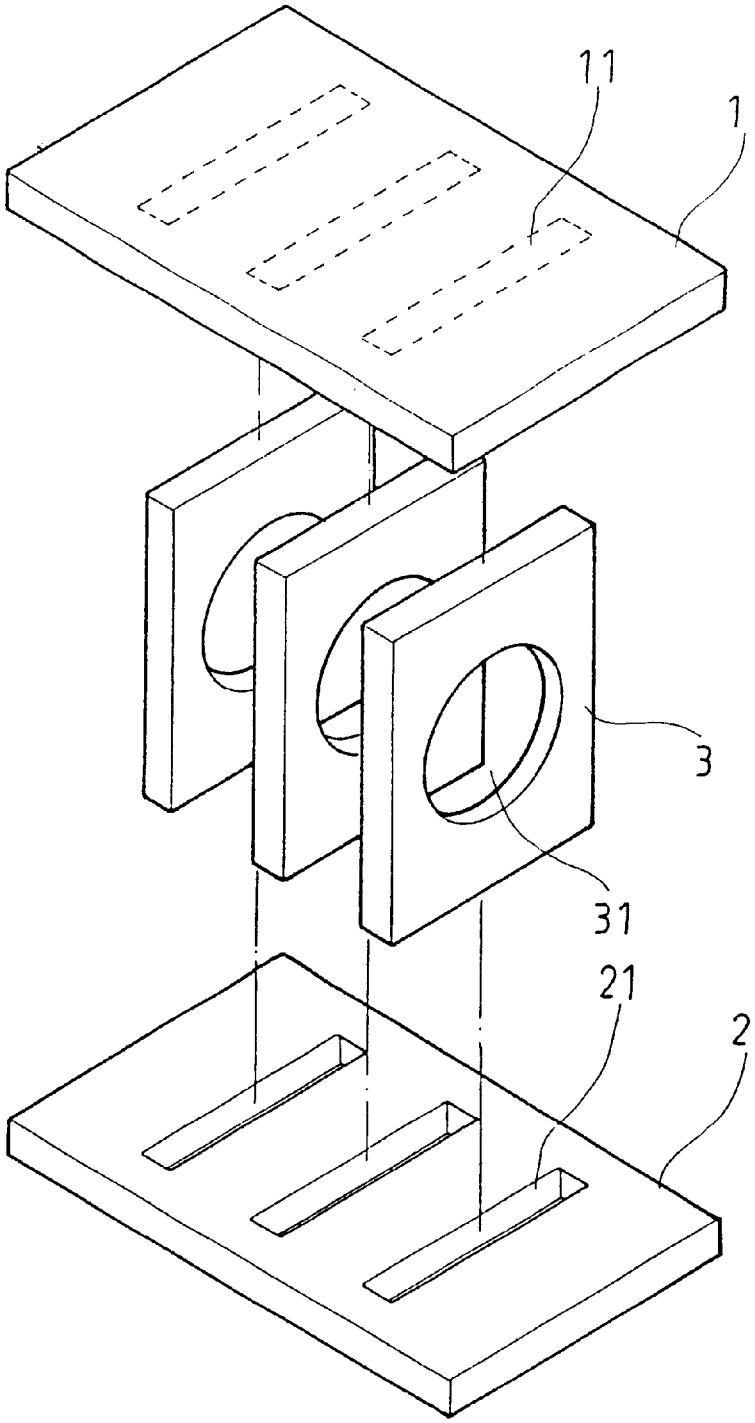
FIG. 5 is an exploded view of still another alternate form of the earthquake energy eliminator according to the present invention.
Figure 6:
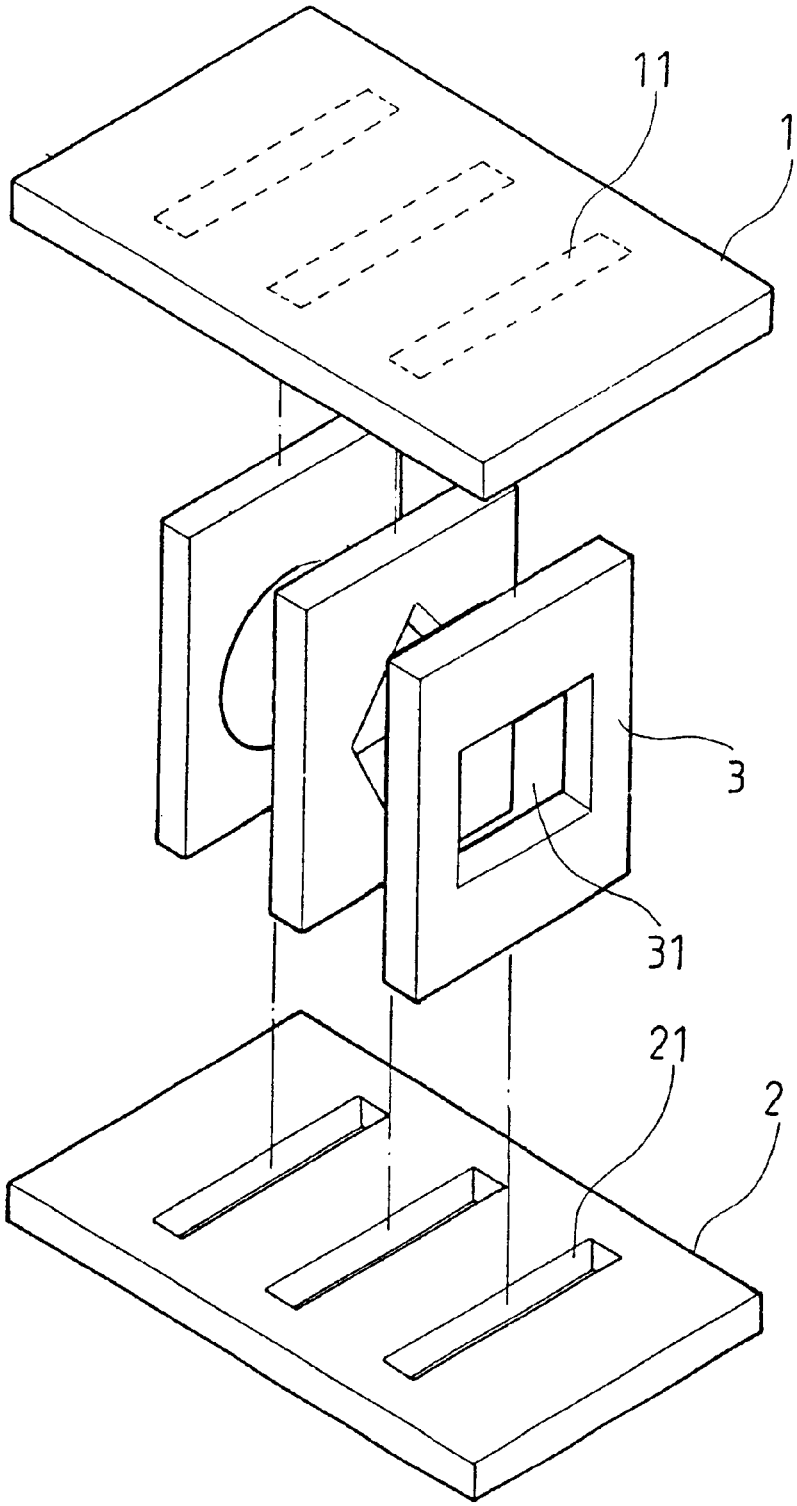
FIG. 6 is an exploded view of still another alternate form of the earthquake energy eliminator according to the present invention.
Figure 7:
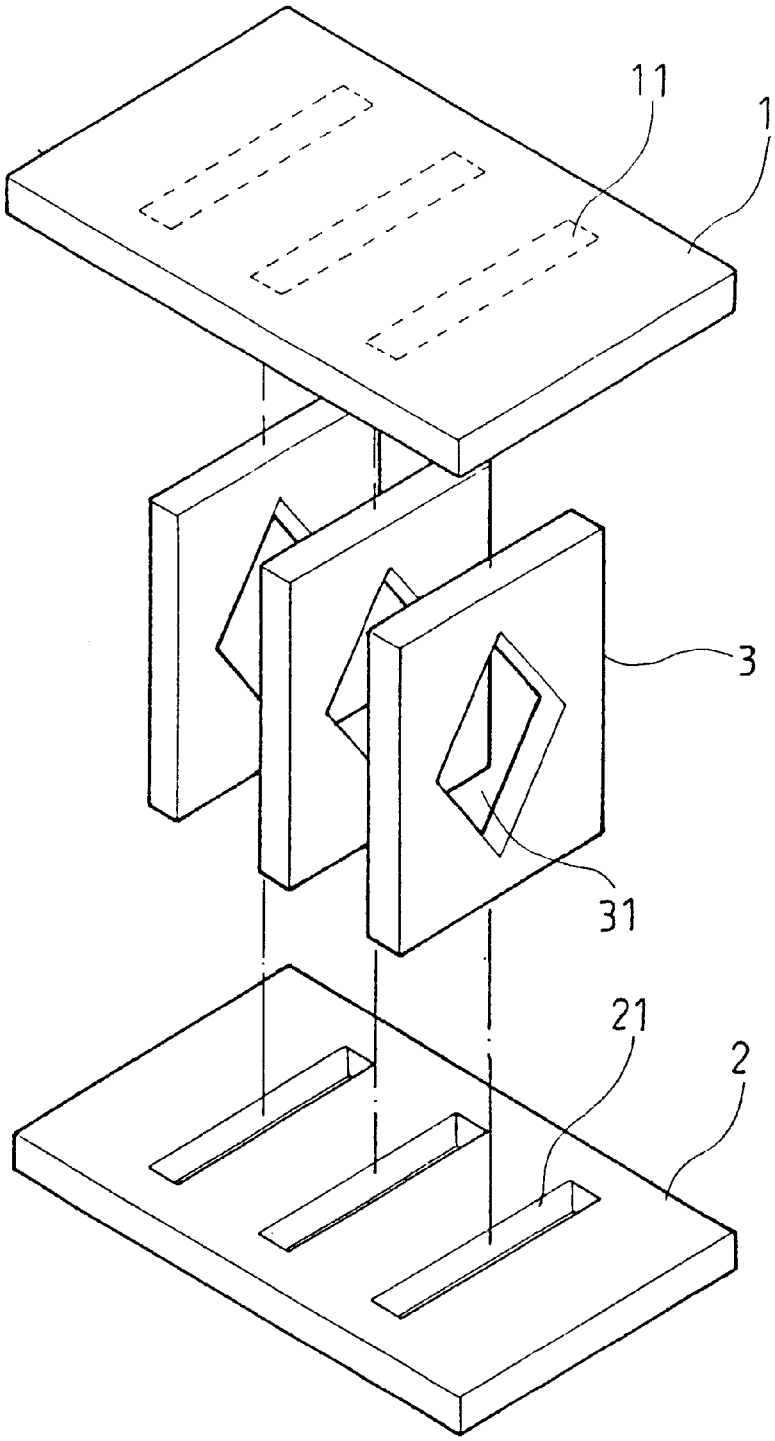
FIG. 7 is an exploded view of still another alternate form of the earthquake energy eliminator according to the present invention.
Figure 8:
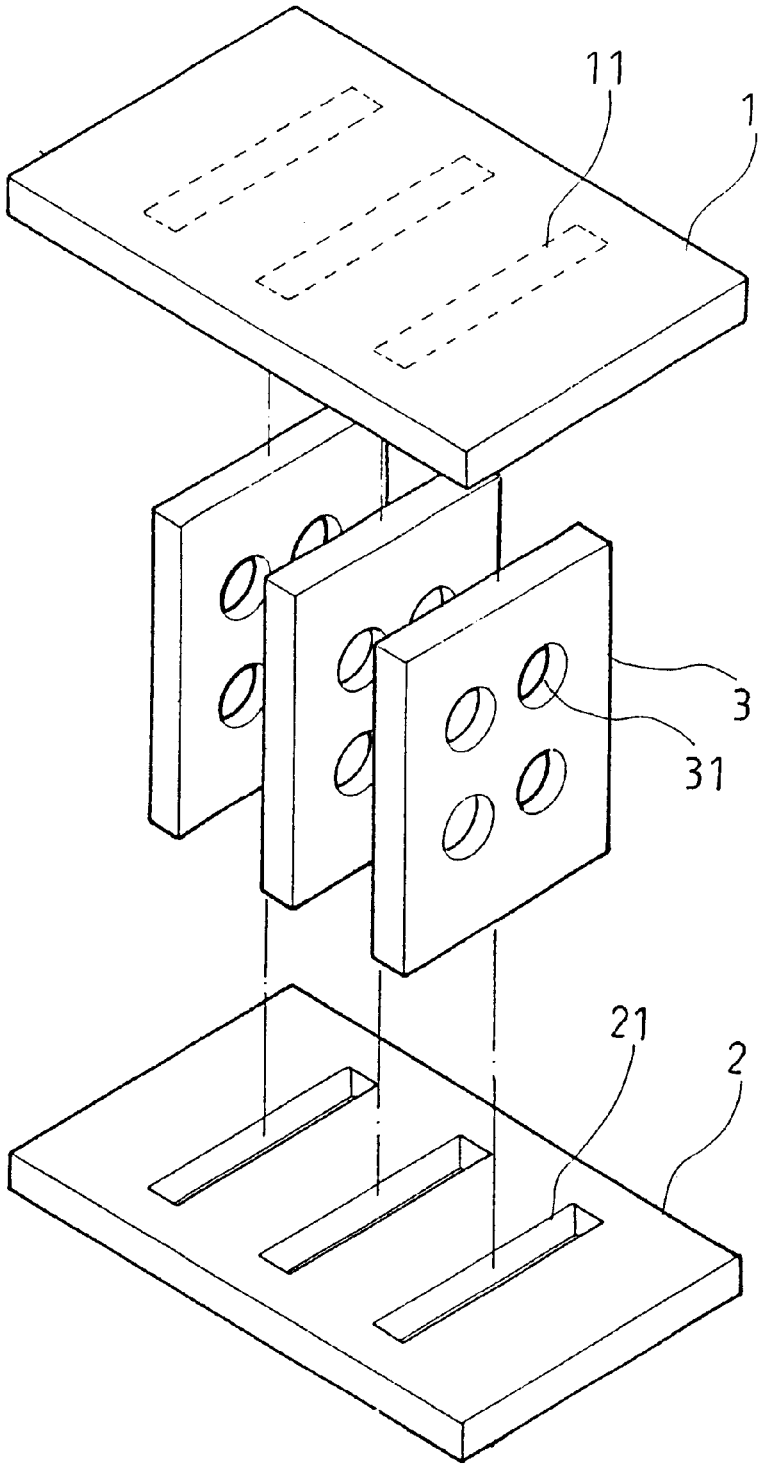
FIG. 8 is an exploded view of still another alternate form of the earthquake energy eliminator according to the present invention.
Figure 9:
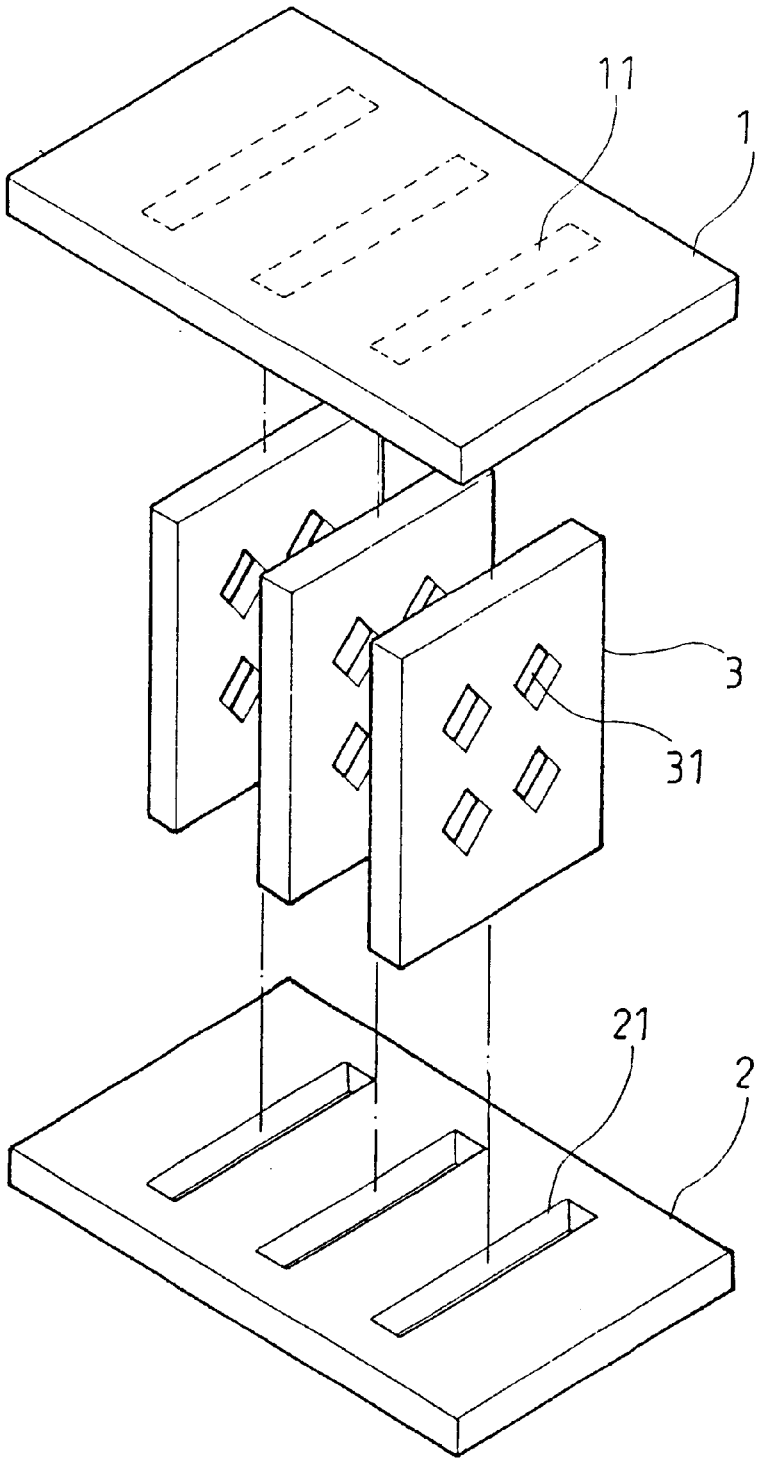
FIG. 9 is an exploded view of still another alternate form of the earthquake energy eliminator according to the present invention.
Figure 10:
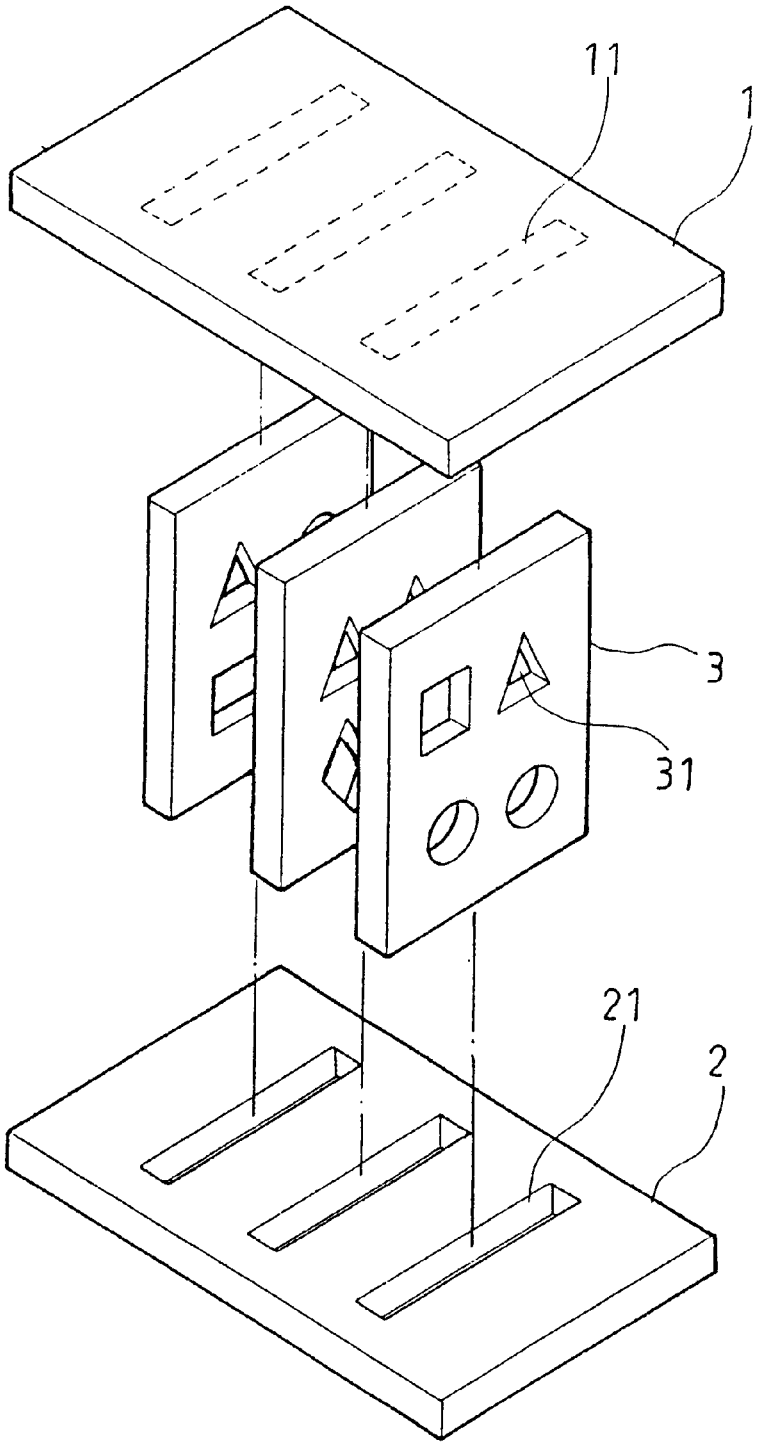
FIG. 10 is an exploded view of still another alternate form of the earthquake energy eliminator according to the present invention.
Figure 11:
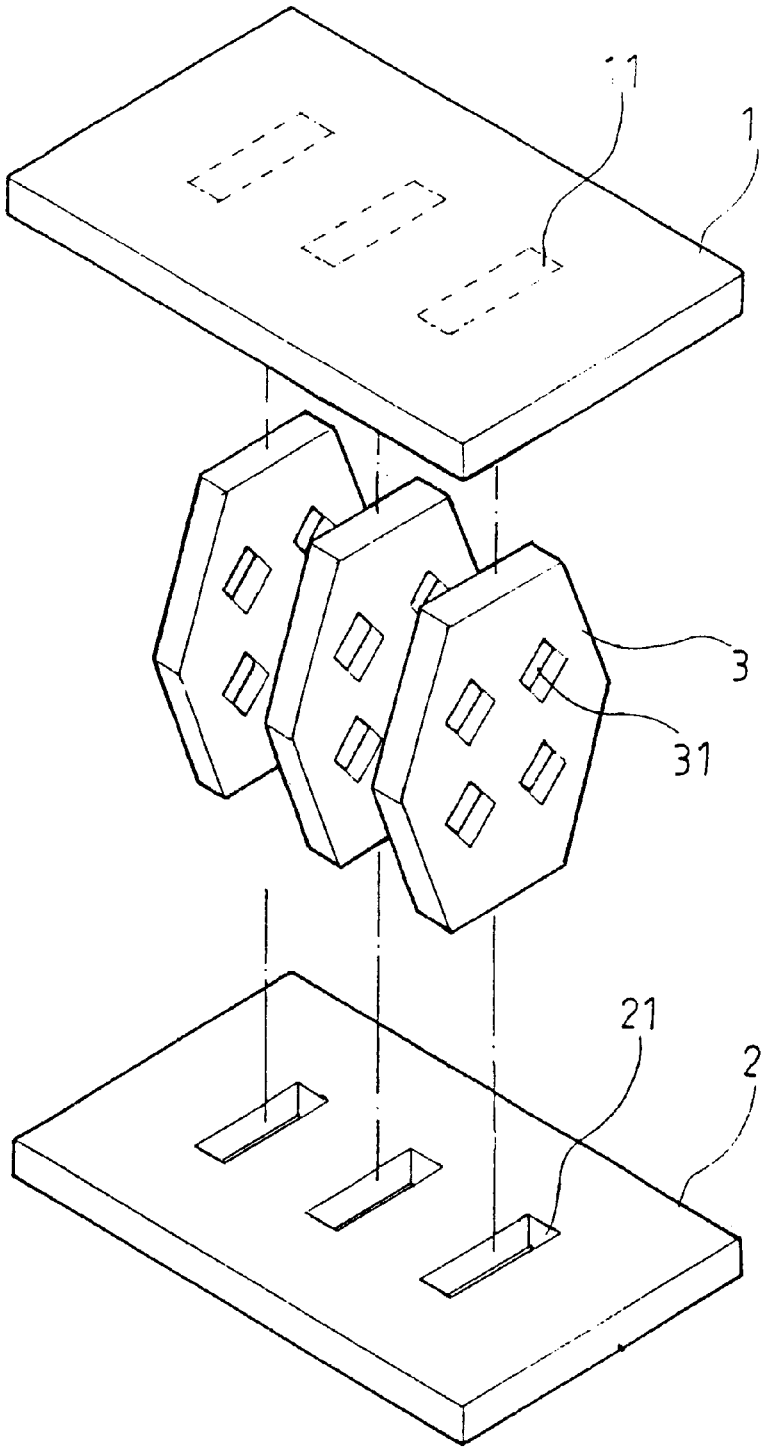
FIG. 11 is an exploded view of still another alternate form of the earthquake energy eliminator according to the present invention.
Figure 12:
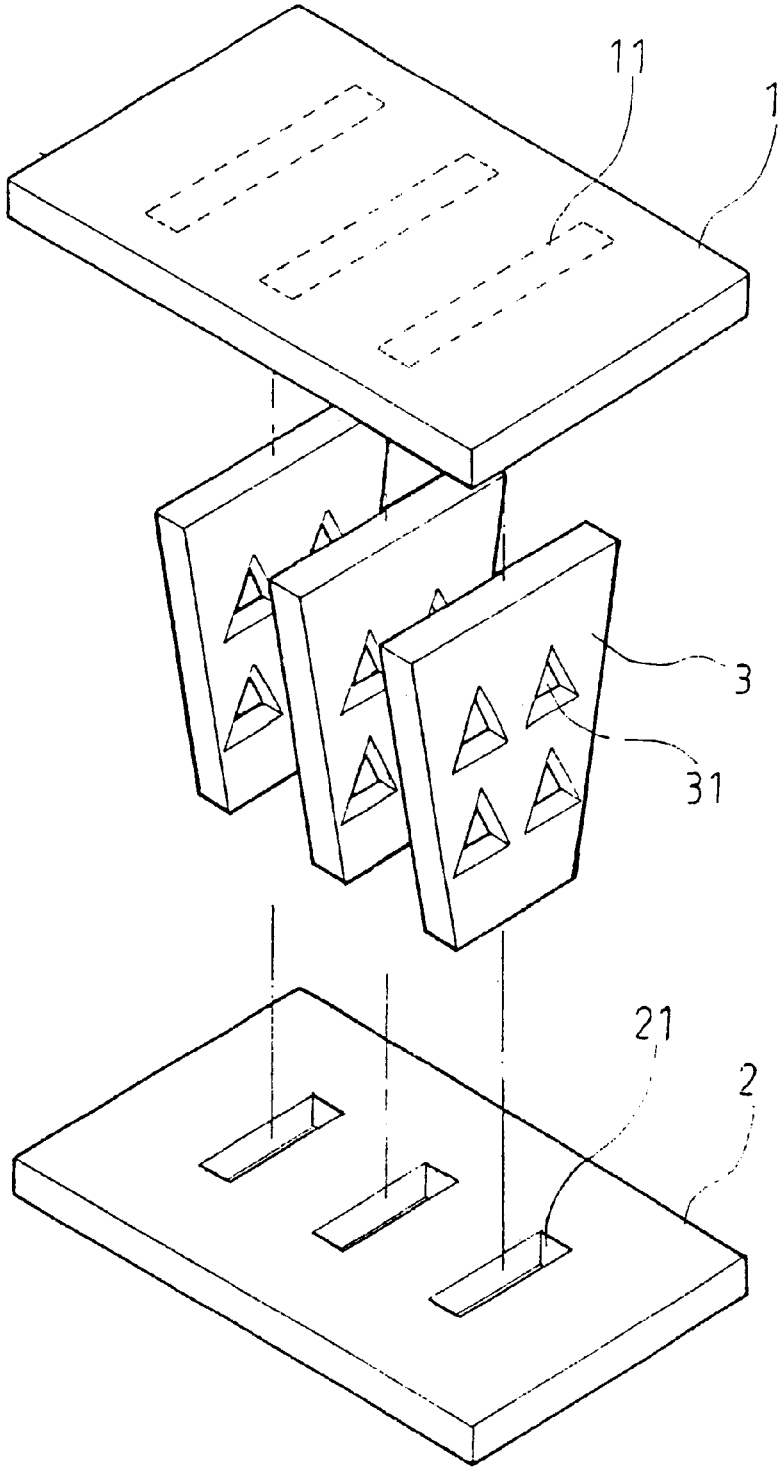
FIG. 12 is an exploded view of still another alternate form of the earthquake energy eliminator according to the present invention.
Figure 13:
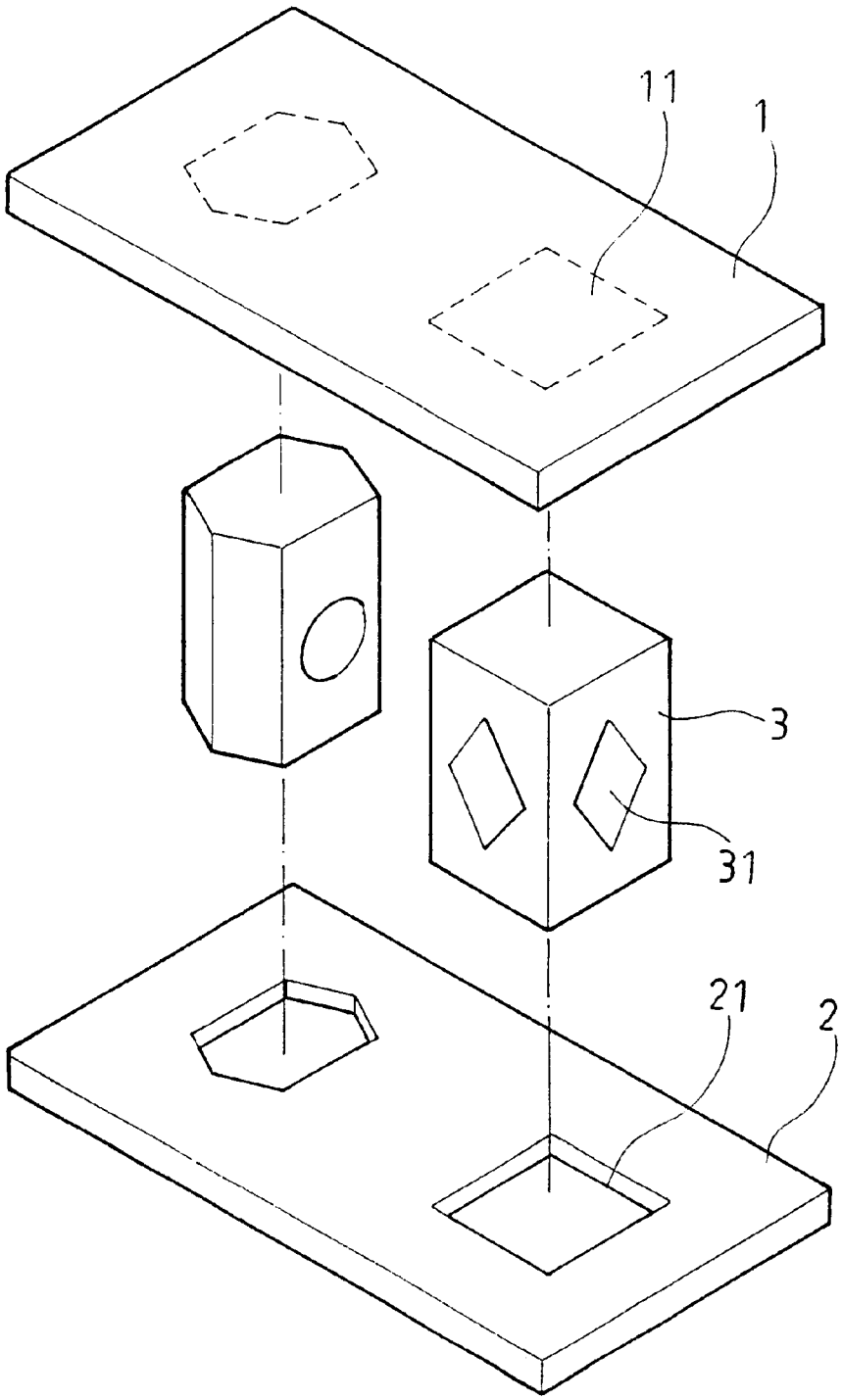
FIG. 13 is an exploded view of still another alternate form of the earthquake energy eliminator according to the present invention.
Figure 14:
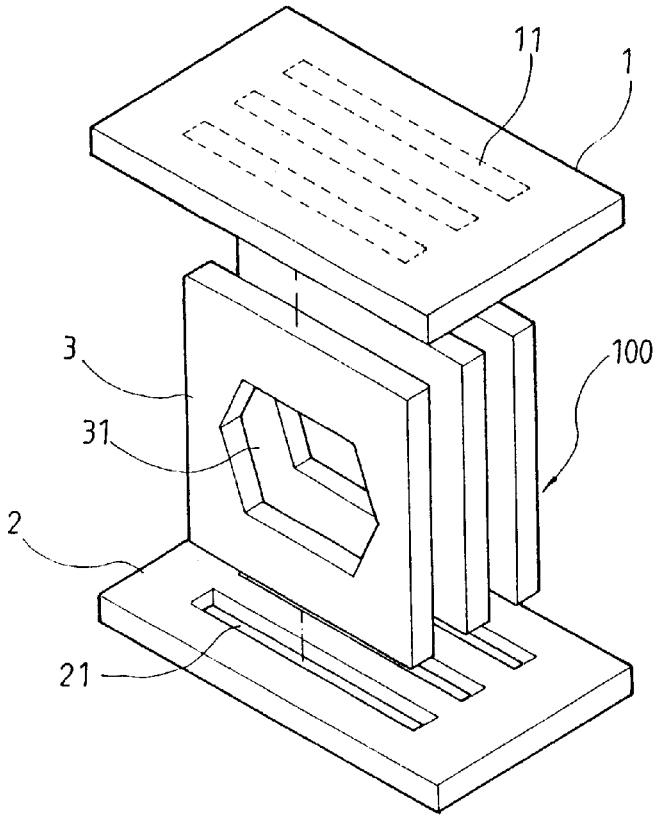
FIG. 14 is an exploded view of still another alternate form of the earthquake energy eliminator according to the present invention.
Figure 15:
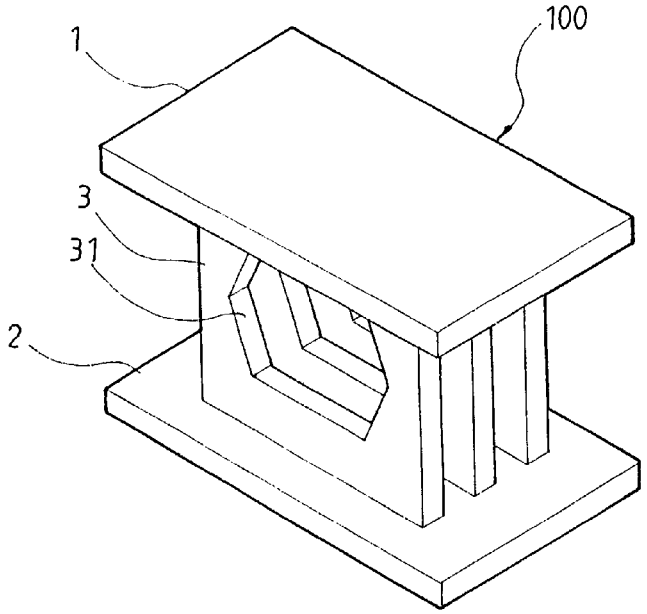
FIG. 15 is an elevational assembly view of the earthquake energy eliminator shown in FIG. 14.
Figure 16:
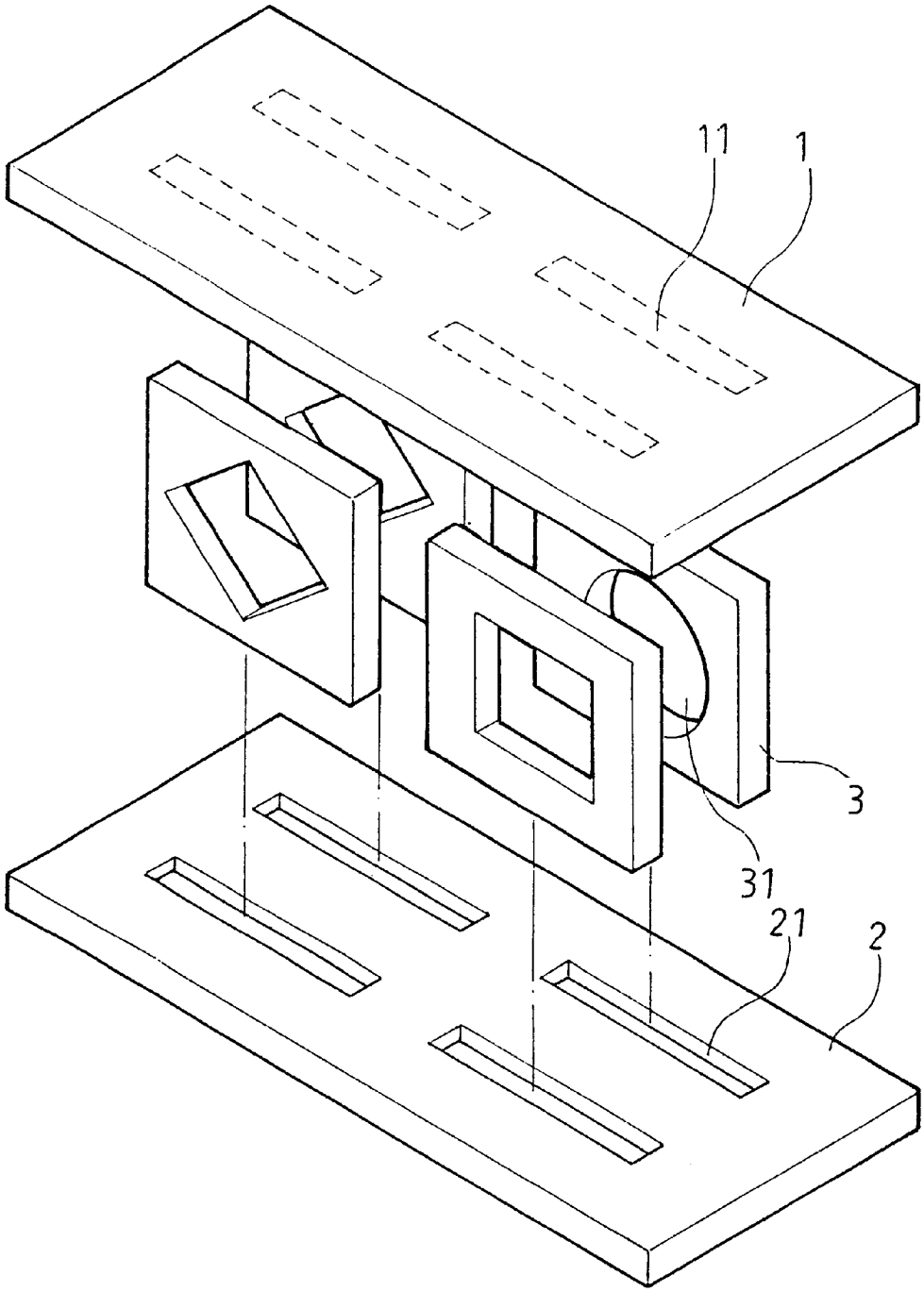
FIG. 16 is an exploded view of still another alternate form of the earthquake energy eliminator according to the present invention.

Referring to FIGS. 1, 2, and 2A, an earthquake energy eliminator 100 in accordance with one embodiment of the present invention is shown comprised of a top bearing plate 1, a bottom bearing plate 2, and a plurality of connecting plates 3 connected between the top bearing plate 1 and the bottom bearing plate 2. The top bearing plate 1 comprises a plurality of elongated mounting holes 11 transversely arranged in parallel in the bottom sidewall thereof. The bottom bearing plate 2 comprises a plurality of elongated mounting holes 21 transversely arranged in parallel in the top sidewall thereof corresponding to the mounting holes 11 of the top bearing plate 1. The connecting plates 3 each have at least one opening 31. The opening 31 may be variously shaped (see FIG. 2 and FIG. 2A). The shape and size of the mounting holes 11;21 correspond to but slightly smaller than the cross section of the connecting plates 3. Before installation, the bearing plates 1;2 are heated to expand the mounting holes 11;21 for enabling the top and bottom sides of the connecting plates 3 to be respectively easily engaged into the mounting holes 11;21 of the bearing plates 1;2. When cooled down, the connecting plates 3 are tightly secured to the bearing plates 1;2. The bearing plates 1;2 and the connecting plates 3 may be made of metal or industrial engineering plastics. When assembled, a welding apparatus or fastening means may be used to seal the connections between the bearing plates 1;2 and the connecting plates 3. The earthquake energy eliminator 100 can be installed in between columns, posts, walls, braces, etc., of a building, bridge, airport construction to absorb and guide out shock waves during an earthquake.

Referring to FIGS. 3, 3A, 3B, and 4, the mounting holes 11;21 may be made having any of a variety of cross sections and depths, and the top and bottom sides of the connecting plates 3 fit the cross section of the mounting holes 11;21. For example, the mounting holes 11;21 can be elongated blind holes of rectangular cross section (see FIG. 3), elongated through holes of rectangular cross section (see FIG. 3A), or elongated through holes of T-shaped cross section (See FIG. 3B).

FIGS. 5~10 show various different alternate forms of the present invention. According to these alternate forms, the connecting plates 3 are rectangular plates each having at least one opening 31. The openings 31 of the connecting plates 3 can be circular through holes, rectangular through holes, triangular through holes, rhombic through holes, etc.

FIGS. 11~16 show other different alternate forms of the present invention. According to the embodiment shown in FIG. 1, the connecting plates 3 are hexagonal plates each having four openings 31 of rhombic shape. According to the embodiment shown in FIG. 12, the connecting plates 3 are trapezoidal plates each having four openings 31 of triangular shape. According to the embodiment shown in FIG. 13, the connecting plates 3 are prisms, each having a plurality of openings 31 disposed in the peripheral sides in communication with one another. According to the embodiment shown in FIGS. 14 and 15, the mounting holes 11;21 of the bearing plates 1;2 are longitudinally arranged in parallel; the connecting plates 3 are rectangular plates fastened to the mounting holes 11;21 and arranged in parallel between the bearing plates 1;2, each connecting plate 3 having a polygonal opening 31. According to the embodiment shown in FIG. 16, the mounting holes 11;21 of the bearing plates 1;2 are longitudinally arranged into parallel lines; the connecting plates 3 are rectangular plates fastened to the mounting holes 11;21 and arranged in parallel lines between the bearing plates 1;2, each connecting plate 3 having an opening 31 of circular, rectangular, or rhombic shape.

A prototype of earthquake energy eliminator has been constructed with the features of FIGS. 1~16. The earthquake energy eliminator functions smoothly to provide all of the features discussed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An earthquake energy eliminator comprising:

a bottom bearing plate having a plurality of mounting holes transversely arranged in parallel in a bottom sidewall thereof;

a top bearing plate having a plurality of mounting holes transversely arranged in parallel in a top sidewall thereof, said mounting holes of said top bearing plate being aligned with said mounting holes of said bottom bearing plate respectively; and a plurality of connecting plates each having at least one opening, said connecting plates being mounted between said bottom bearing plate and said top bearing plates;

wherein said top and bottom bearing plates are heated to expand said mounting holes of said top and bottom bearing plates for enabling top and bottom sides of said connecting plates to be respectively engaged into said mounting holes of said top and bottom bearing plates thereby securing said connecting plates to said top and bottom bearing plates when cooled down.

2. The earthquake energy eliminator as claimed in claim 1, wherein connections between said top and bottom bearing plates and said connecting plates are sealed by welding.

* * * * *